United States Patent [19]

Atkins et al.

[11] 4,040,375

[45] Aug. 9, 1977

[54] BOAT STEERING SYSTEM

[75] Inventors: Frederick Joseph Atkins, West Roxbury; Henry Rich Keene, Dedham, both of Mass.

[73] Assignee: The Edson Corporation, New Bedford, Mass.

[21] Appl. No.: 689,371

[22] Filed: May 24, 1976

Related U.S. Application Data

[63] Continuation-in-part of Ser. No. 615,693, Sept. 22, 1975, abandoned.

[51] Int. Cl.[2] ..... B63H 25/10

[52] U.S. Cl. ..... 114/160; 114/144 R

[58] Field of Search ..... 114/144 R, 160, 154, 114/156, 161; 254/190 R, 195, 190 D, 175.3

[56] References Cited

U.S. PATENT DOCUMENTS 8,546 11/1851 Mortimer et al. ..... 114/160

FOREIGN PATENT DOCUMENTS 426,385 4/1935 United Kingdom ..... 114/160

OTHER PUBLICATIONS

Catalog, The Edson Corp., Copyright 1972, pp. 8, 54 & 56.

*Primary Examiner*—Trygve M. Blix
*Assistant Examiner*—Gregory W. O'Connor

[57] ABSTRACT

A boat steering system has a rudder post actuator, a steering actuator, a pair of operating strands trained therebetween and an adjustable strand directing mechanism positioned between the rudder post actuator and the steering actuator for changing the direction of the operating strands. Such mechanism comprises a base plate defining a mounting plane and having an aperture for the operating strands and a strand directing pulley cooperating with the aperture for changing the direction of the strand passing therethrough. Both pulleys are mounted for rotation in a plane perpendicular to the mounting plate plane and have adjustable mounting means, including a link mounted for arcuate movement for arcuate adjustment of the pulley in the mounting plane while maintaining the rim of the pulley adjacent the aperture.

7 Claims, 5 Drawing Figures

BOAT STEERING SYSTEM

This application is a continuation-in-part of our application Ser. No. 615,693 filed Sept. 22, 1975, now abandoned.

Its invention relates to boat steering systems and, more particularly, to steering systems of the type in which a pair of flexible strand operating members are trained between the steering wheel shaft actuator and the rudder post quadrant or other actuator.

Although systems of this type are widely used, they are frequently difficult and expensive to install because of the need for installing pulleys in the interior of the boat hull so that the strands can be led from the steering wheel, which is usually mounted in a vertical plane on a bulkhead or pedestal, first vertically downwardly below a deck and then usually rearwardly in a generally horizontal direction to a quadrant or other rudder post actuator.

It is a major object of the present invention to provide a boat steering system of the flexible strand type which may be more quickly and easily installed in a wide variety of boat hulls.

This has been accomplished, according to the present invention, by providing, in a boat steering system having rudder post actuating means, steering actuating means and a pair of operating strands trained therebetween, preassembled, adjustable strand directing mechanism positioned between the rudder post actuating means and the steering actuating means for independently changing the direction of each of the operating strands. More specifically, such mechanism comprises a base plate defining a mounting plane and having a pair of spaced apertures for the operating strands, and a strand directing pulley having a peripheral strand supporting rim cooperating with each of the apertures for changing the direction of the strand passing therethrough. The pulley is mounted for rotation in a plane perpendicular to the mounting plate plane and has adjustable mounting means, preferably including a link permanently mounted for arcuate movement about the axis of an aperture for each of the pulleys, for independent arcuate adjustment of the pulley in the mounting plate plane while maintaining the rim of the pulley tangent to the axis of its cooperating aperture. The axes of the apertures are preferably spaced both athwartships and fore and aft from one another. Locking means are also provided for selectively securing the adjustable mounting means in its adjusted position.

For the purpose of fully explaining further objects and features of the invention, reference is now made to the following detailed description of a preferred embodiment thereof, together with the accompanying drawing, wherein.

Figure 1:
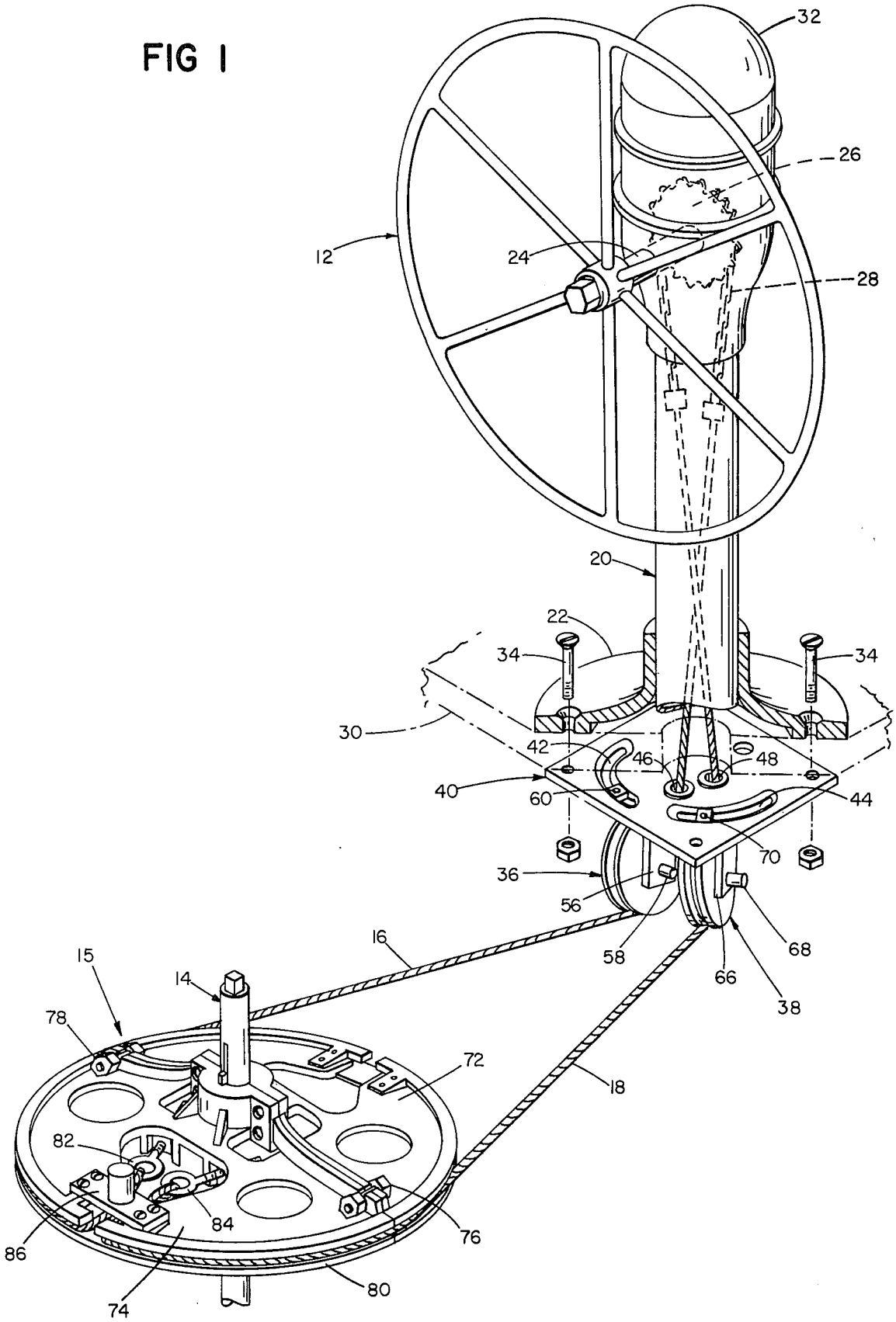
FIG. 1 is an isometric view, partly broken away, of the steering system of the invention.
Figure 2:
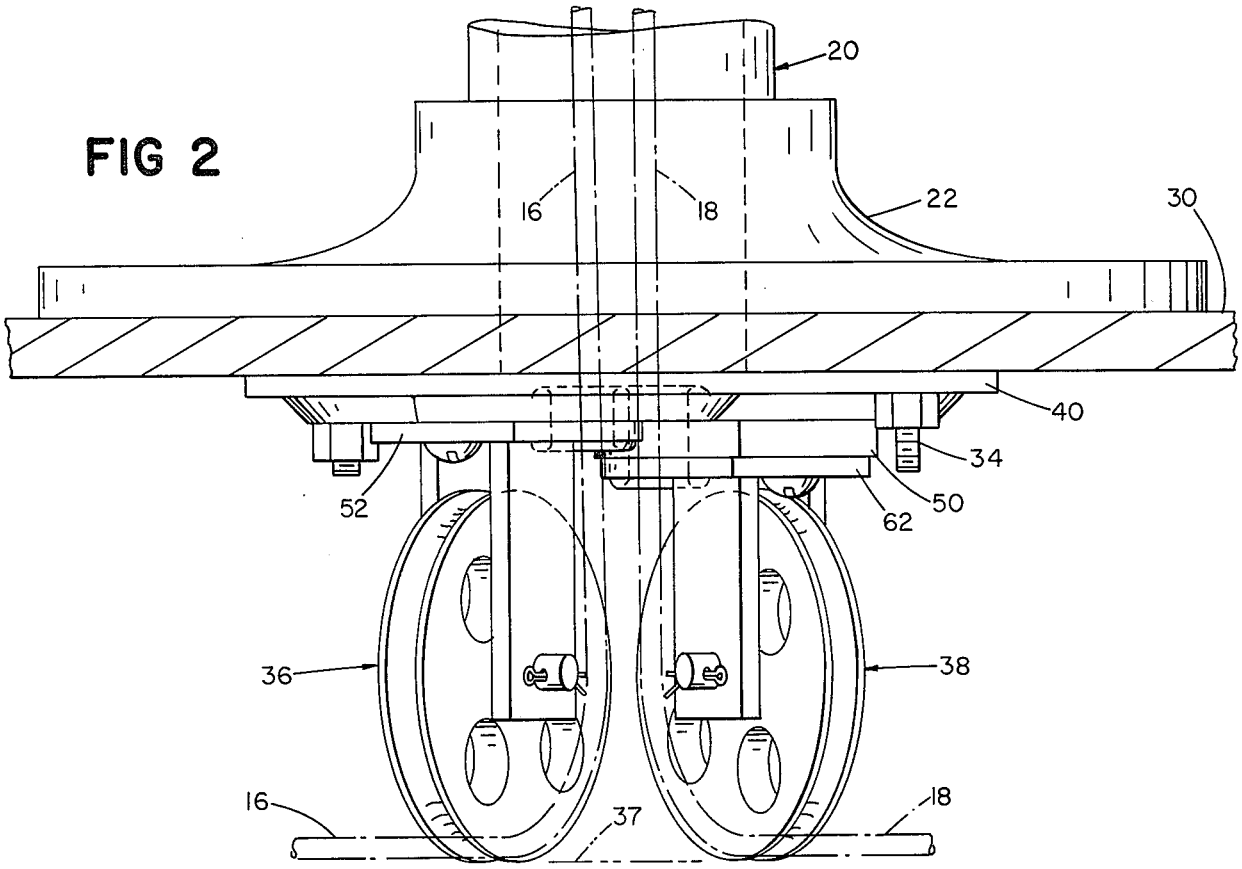
FIGS. 2 and 3 are, respectively, an end view and a side view of the adjustable strand directing mechanism of the invention.
Figure 3:
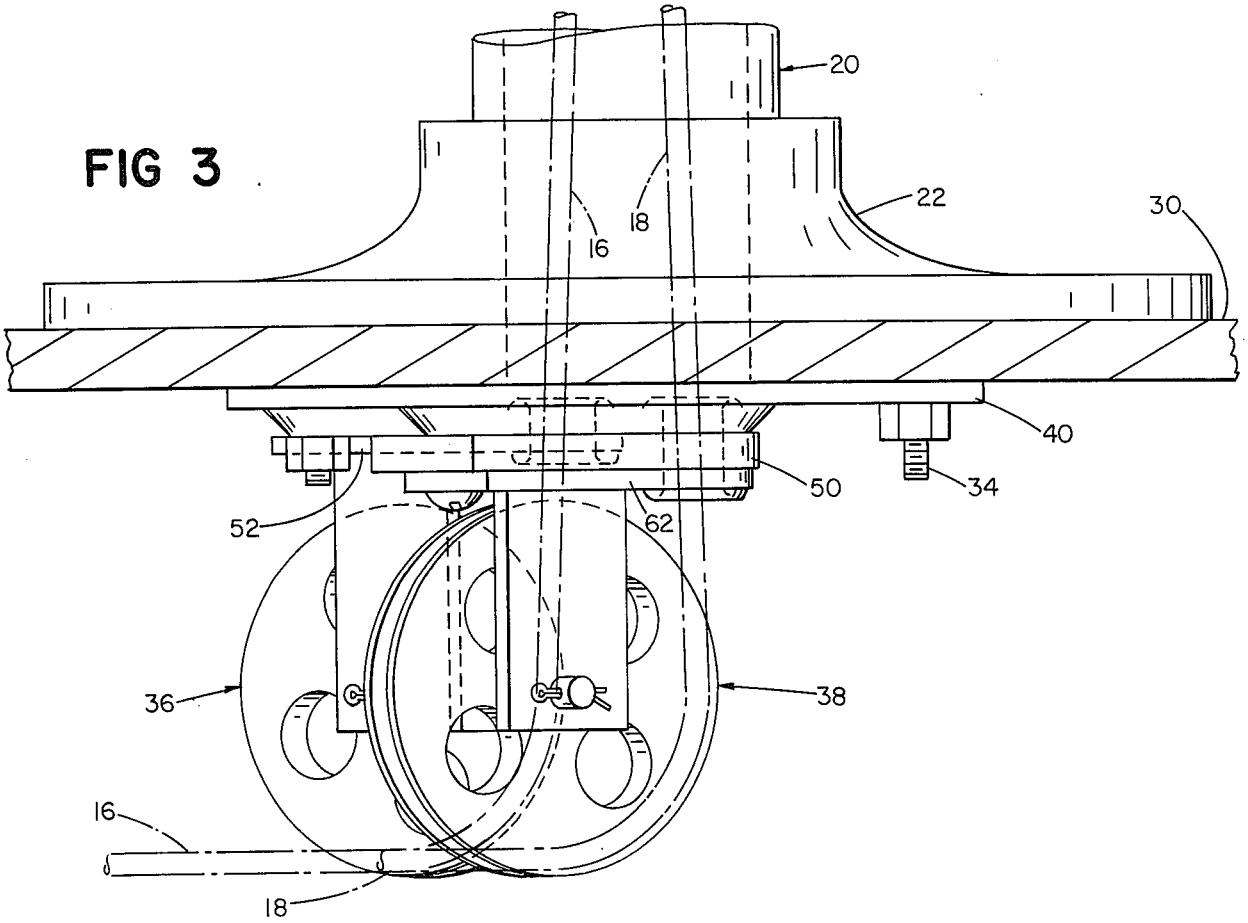
Figure 4:
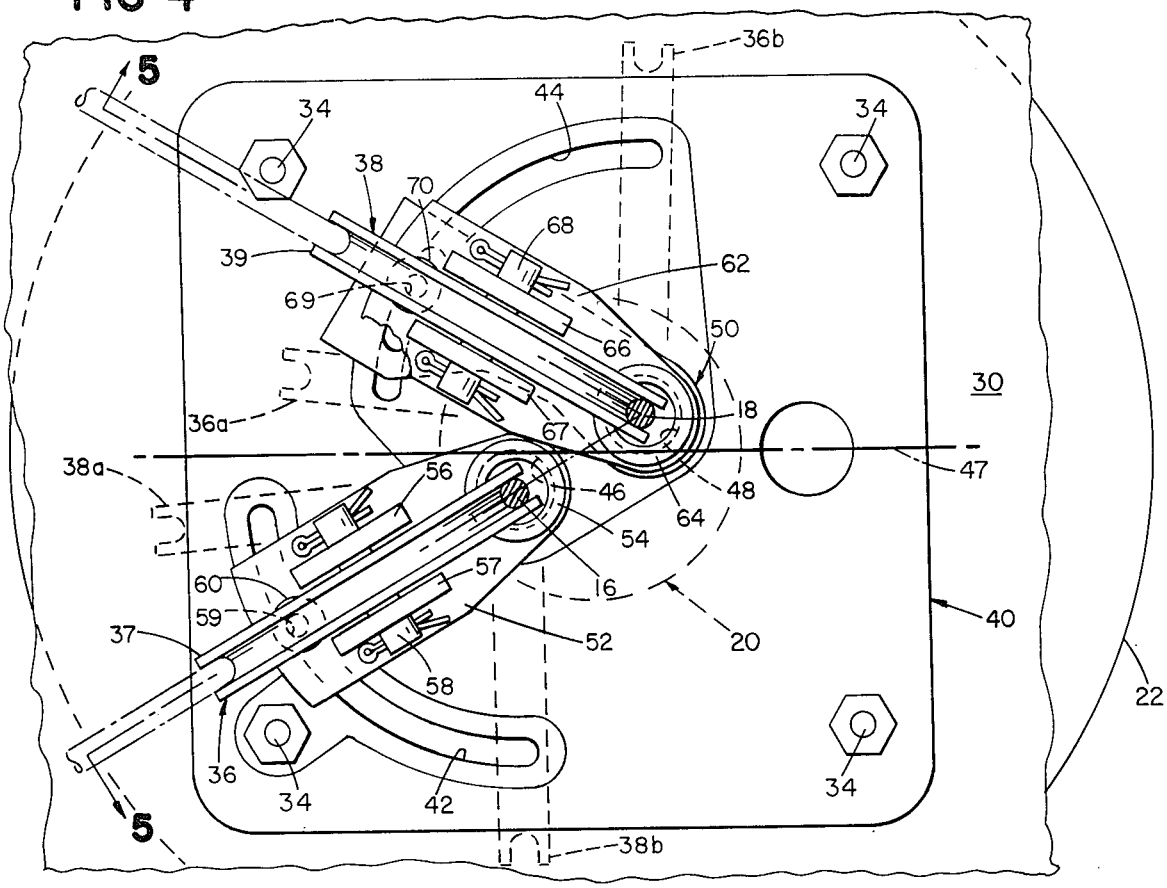
FIGS. 4 and 5 are, respectively, a bottom view and a side sectional view of the adjustable strand directing mechanism of the invention.
Figure 5:
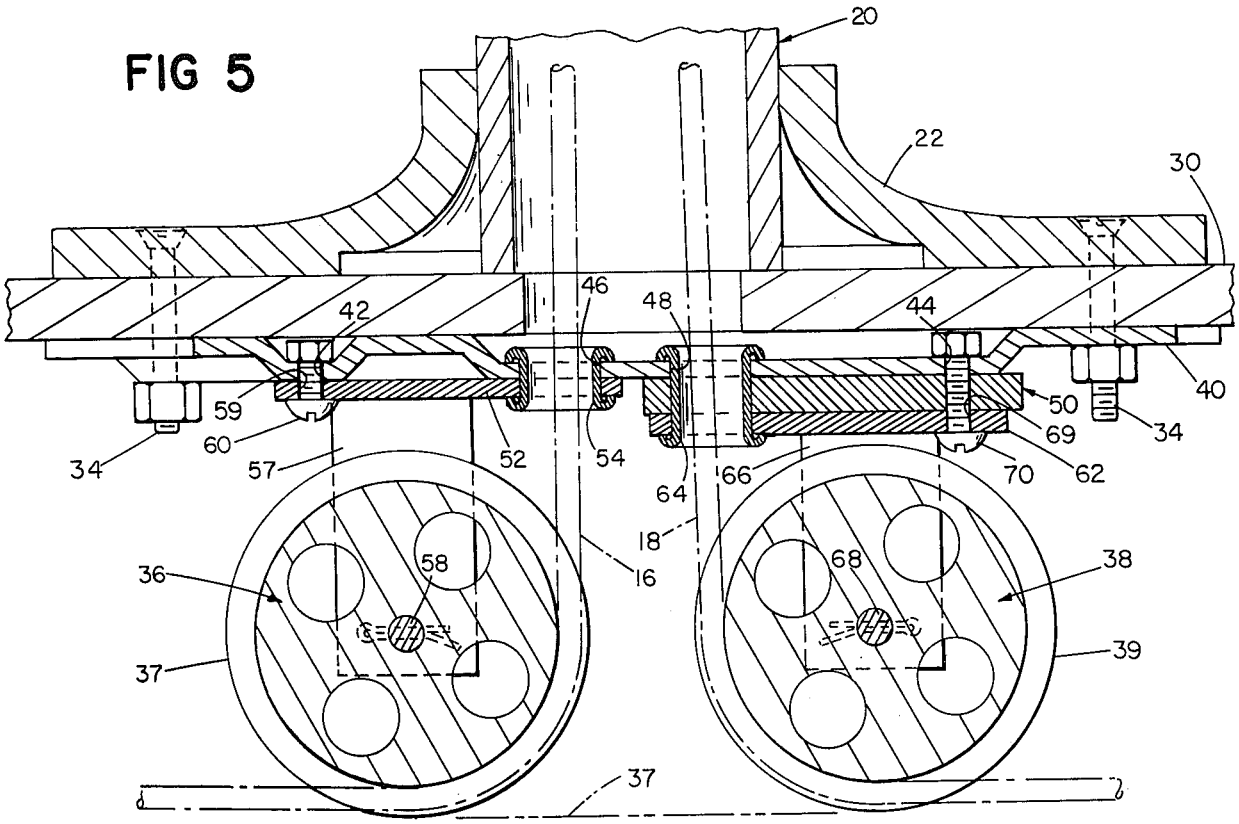

Referring to the drawings and particularly to FIG. 1 thereof, the steering system of the invention is shown as used with a pedestal mounted steering wheel 12, although it can also be used with other types of mountings, including bulkhead mountings, for driving a generally vertical rudder post 14, on which is mounted a rudder (not shown) by means of a rudder post wheel, generally designated 15, by means of a pair of flexible operating strands 16, 18, such as of wire rope, extending therebetween. The steering system of the invention is particularly effective in boats in which the rudder post is located a relatively short distance aft of the steering wheel. The forward position of the steering wheel relatively to the rudder post makes it necessary to cross the strands for the desired direction of steering and the adjustable idler of the present invention makes it possible to do this within the pedestal.

The pedestal mounting of steering wheel 12 is conventional and includes a vertically extending hollow pedestal 20 having a base 22 mounted on the boat deck 30. Near the upper end of pedestal 20 is mounted the generally horizontal shaft 24 of steering wheel 12. For moving the operating strands 16, 18, to provide portions extending radially outwardly from the axis of shaft 24 in opposite directions, there is mounted on shaft 24 within hollow pedestal 20, a chain sprocket 26, around which is trained a short length of chain 28. The ends of chain 28 extend in flights below sprocket 26, the lower ends thereof being attached to the ends of operating strands 16, 18 within pedestal 20. Strands 16, 18 are shown crossed within hollow pedestal 20 in order to provide the desired directional coordination between the steering wheel 12 and rudder post 14 in the boat configuration as shown in FIG. 1, with the rudder post aft of the steering wheel, but may be installed parallel if the opposite directional coordination is desired. A binnacle 32 is conventionally provided on the upper end of pedestal 20. Other types of known drive mechanisms may also be used.

As best shown in FIGS. 2 through 5, the preassembled adjustable strand directing mechanism of the invention, for independently changing the direction of each of operating strands 16, 18, is mounted on the lower end of pedestal 20, beneath its base 22 and boat deck 30, by means of mounting bolts 34 extending downwardly through deck 30 into cooperating threaded nuts under base plate 40.

In general, such mechanism comprises an integral base plate 40, preferably of stamped sheet metal, having adjustably mounted thereon a pair of independently adjustable strand directing pulleys 36, 38. More specifically, base plate 40 defines a generally horizontal mounting plane and has a pair of spaced apertures 46, 48 for strands 16, 18, respectively, said apertures having spaced axes generally perpendicular to said mounting plane. Base plate 40 is mounted beneath the base 22 of pedestal 20 with strands 16, 18 passing through apertures 46, 48, respectively.

It is a particular feature of the invention that the axes of apertures 46, 48 are spaced athwartships on opposite sides of the central fore and aft axis 47 of base plate 40 and are additionally displaced a substantial distance in a fore and aft direction, to locate them in positions skewed with respect to one another, so that the strands 16, 18 may cross without interference from one another in their flight within pedestal 20 between steering wheel shaft 24 and pulleys 36, 38, since they are neither parallel nor intersecting in that flight.

Each of strand directing pulleys 36, 38 is mounted for rotation in a plane perpendicular to the mounting plate plane and has a peripheral strand supporting rim 37, 39, respectively, cooperating with apertures 46, 48, respectively, for changing the direction of the strand passing therethrough, generally from a vertical to a horizontal direction, and permitting independent arcuate adjustment thereof in the mounting plane of base plate 40 so that each pulley rim can be adjusted to be co-tangent to the side of rudder post wheel 15 to which its strand is connected, while simultaneously maintaining the pulley rim 37, 39 tangent to the axis of its cooperating aperture 46, 48 and also tangent to a common plane 37 parallel to that of base plate 40. This latter feature of the present invention makes possible the use of a steering post wheel having a strand supporting rim in a single plane.

For so mounting each of pulleys 36, 38, there is provided a link, 52, 62, respectively, mounted for arcuate movement about the axis of its base plate aperture 46, 48, respectively, by means of permanently installed grommets 54, 64, respectively. To this end, each link has a circular aperture, of the same diameter as its cooperating base plate aperture, located in a link movement plane parallel to the mounting plane. The axis of each said link aperture is generally perpendicular to the mounting plane and coaxial with its cooperating base plate aperture. Grommets 54, 64 provide link mounting for permanently rotatably mounting each link 52, 62 on base plate 40 for arcuate movement about the axis of its cooperating base plate aperture. Each grommet 54, 64 has a cylindrical central portion extending through its link aperture and its cooperating base plate aperture and outwardly flanged end portions, one of said end portions overlying the link and the other of said end portions overlying the base plate, permanently maintaining each link and cooperating base plate aperture coaxial and adjacent to one another for arcuate adjustment thereof. Link 62 is provided with a spacer 50 so that the links can be overlapped to make possible their adjustment more nearly into parallelism.

On each of links 52, 62 are mounted a pair of downwardly extending pulley support members 56, 57 and 66, 67, respectively, supporting pulleys 36, 38 therebetween by their shafts 58, 68, respectively. To locate the bottom of pulleys 36, 38 tangent to a common plane 37 parallel to that of base plate 40, pulley support members 56, 57 are longer than pulley support members 66, 67 by the thickness of spacer 50.

A locking device is provided for selectively securing each link and its pulley in the desired arcuately adjusted position. More specifically, there is provided in base plate 40, a pair of curved recessed slots 42, 44, one for each of links 52, 62, respectively. Slots 42, 44 are of constant radius from the axis of their cooperating aperture 46, 48, respectively. A fastener receiving opening in the form of a bore 59, 69 is provided in each of links 52, 62 respectively, adjacent the free end of the link and spaced from its aperture axis, and a fastener in the form of a machine screw and nut 60, 70, respectively, extends through the link bore and the slot for clamping the link to base plate 40. Slots 42, 44, permit the adjustment and clamping of links 52, 62 anywhere between a position in which the pulleys are nearly parallel at 36*a* and 38*a,* as is needed when steering post wheel 15 is relatively far distant, to a 180° position at 36*b* and 38*b.*

The details of rudder post wheel 15 are best shown in FIG. 1. Referring to that FIG., the rudder post wheel 15 includes a pair of semi-circular segments 72, 74 clamped together around rudder post 14 by fasteners 76, 78, respectively, providing a rudder post actuating wheel 15 axially mounted on rudder post 14 having its strand supporting rim in a single, generally horizontal, plane, which, however, may be somewhat tilted from the horizontal, providing portions extending radially outwardly in opposite directions in the form of a single, planar, peripheral strand supporting rim 80. At one side of segment 74 on the side thereof away from the adjustable strand directing mechanism is provided strand securing and terminating means in the form of a pair of generally radially extending threaded members 82, 84, extending into threaded bores in segment 74, to which the ends of strands 16, 18 are suitably secured after being trained around opposite sides of wheel rim 80. A clamp member 86 may also be provided for securely clamping the strands to segment 74.

To install the boat steering system of the invention, for example, in a boat in which the rudder post is a relatively short distance aft of the steering pedestal, as depicted in FIG. 1, all that is necessary is to provide a central hole and four side holes in boat deck 30, mount pedestal 20 and base plate 40 together on opposite side thereof with bolts 34, mount wheel 15 on rudder post 14, adjust pulleys 36, 38 for co-tangency with the opposite sides of the rim of wheel 15, connect chain 28 between the ends of strands 16, 18, train the strands downwardly through and cross them within pedestal 20 (its top is removable for this purpose), around pulleys 36, 38 and directly to the opposite sides of the rim 80 of wheel 15 without crossing them, attach their ends to strand securing fasteners 82, 84 thereon and tighten said fasteners as desired, and finally install clamp 86. The offset apertures in base 40 cooperating with similarly offset pulleys 36, 38, skewed by spacing them both athwartships and fore and aft from one another, permit the training of strands 36, 38 within pedestal to cross while remaining spaced from one another, to obtain the desired direction of steering.

The operation of the system is conventional.

What is claimed is:

1. In a boat steering system having rudder post actuating means having portions extending radially outwardly from the axis of a rudder post steering actuating means having portions extending radially outwardly from the axis of a steering shaft and a pair of operating strands extending between said outwardly extending portions of said rudder post and steering actuating means that improvement which consists of:

preassembled adjustable strand directing mechanism positioned between said rudder post actuating means and said steering actuating means for independently adjusting the direction of each of said operating strands, said mechanism comprising an integral base plate defining a mounting plane and having a pair of spaced circular apertures of predetermined diameter for said operating strands, said apertures having spaced axes generally perpendicular to said mounting plane, a pair of strand directing pulleys each having a peripheral strand supporting rim cooperating with one of said apertures for changing the direction of the strand passing therethrough, each said pulley being mounted for rotation in a plane perpendicular to said mounting plate plane adjustable supporting means mounting each of said pulleys on said base plate for independent arcuate adjustment thereof in a plane parallel to said mounting plane while maintaining the rim of said pulley tangent to the axis of its cooperating base plate aperture each said supporting means including a link having a pulley rotatably mounted thereon, and link mounting means permanently rotatably mounting said link on said base plate for arcuate movement about the axis of its cooperating base plate aperture and locking means on said base plate and each said link for selectively securing each said link in arcuately adjusted position on said base plate.

2. In a boat steering system as claimed in claim 1, wherein said aperture axes are spaced in skewed locations from one another.

3. In a boat steering system as claimed in claim 1, wherein said link mounting means comprises a permanently installed grommet member extending through said link aperture and its cooperating base plate aperture maintaining said link and cooperating base plate aperture coaxial and adjacent to one another for said arcuate adjustment.

4. In a boat steering system as claimed in claim 3, wherein said circular aperture of said link is of the same diameter as its cooperating base plate aperture and said grommet member has a cylindrical central portion extending through said link aperture and its cooperating base plate aperture and outwardly flanged end portions, one of said end portions overlying said link and the other of said end portions overlying said base plate.

5. In a boat steering system having rudder post actuating means having portions extending radially outwardly from the axis of a rudder post steering actuating means having portions extending radially outwardly from the axis of a steering shaft and a pair of operating strands extending between said outwardly extending portions of said rudder post and steering actuating means that improvement which consists of:

preassembled adjustable strand directing mechanism positioned between said rudder post actuating means and said steering actuating means for independently adjusting the direction of each of said operating strands, said mechanism comprising an integral base plate defining a mounting plane and having a pair of spaced circular apertures of predetermined diameter for said operating strands, said aperture having spaced axes generally perpendicular to said mounting plane, said axes being spaced both athwartships and in a fore and aft direction from one another a pair of strand directing pulleys each having a peripheral strand supporting rim cooperating with one of said apertures for changing the direction of the strand passing therethrough, each said pulley being mounted for rotation in a plane perpendicular to said mounting plate plane and adjustable supporting means mounting each of said pulleys on said base plate for independent arcuate adjustment thereof in a plane parallel to said mounting plane while maintaining the rim of said pulley tangent to the axis of its cooperating base plate aperture and the rim of both pulleys tangent to a plane parallel to said mounting plane each said supporting means including a link having a pulley rotatably mounted thereon, said link having a circular aperture, of the same diameter as its cooperating base plate aperture, in a link movement plane parallel to said mounting plane, the axis of said link aperture being generally perpendicular to said mounting plane and coaxial with its cooperating base plate aperture and link mounting means permanently rotatably mounting said link on said base plate for arcuate movement abut the axis of its cooperating base plate aperture, said link mounting means comprising a permanently installed grommet member having a cylindrical central portion extending through said link aperture and its cooperating base plate aperture and outwardly flanged end portions, one of said end portions overlying said link and the other of said end portions overlying said base plate maintaining said link and cooperating base plate aperture coaxial and adjacent to one another for said arcuate adjustment thereof and locking means on said base plate and each said link for selectively securing each said link in arcuately adjusted position on said base plate, said locking means including a curved slot in said base plate of constant radius from a said aperture axis a fastener receiving opening in each said link spaced from its aperture axis and fastener means extending through each said slot and said opening for clamping each said link to said base plate.

6. In a boat steering system as claimed in claim 1, wherein said locking means includes a curved slot in said base plate of constant radius from a said aperture axis a fastener receiving opening in each said link spaced from its aperture axis and fastener means extending through each said slot and said opening for clamping each said link to said base plate.

7. A steering system for a boat having a generally vertical rudder post, comprising a rudder post actuating wheel axially mounted in a generally horizontal plane on said rudder post, said wheel having a peripheral planar strand supporting rim and strand securing means for supporting strands in a common plane thereon steering means forward of said rudder post including a generally horizontal steering shaft steering actuating means having portions extending radially outwardly from the axis of said shaft in opposite directions said steering means and said steering actuating means being mounted adjacent the upper end of a vertically extending hollow pedestal having a base portion with said steering actuating means therewithin, a pair of operating strands extending between said rudder post actuating wheel and said outwardly extending portions of said steering shaft and positioned and crossed within said hollow pedestal, and preassembled adjustable strand directing mechanism mounted on the lower end of said pedestal for independently changing the direction of each of said operating strands, said mechanism comprising an integral base plate defining a mounting plane and having a pair of spaced circular apertures of predetermined diameter for said operating strands, said apertures having spaced axes generally perpendicular to said mounting plane, said axes being spaced both athwartships and in a fore and aft direction from one another said base plate being mounted on said pedestal base portion with said apertures therebeneath and said strands passing through said apertures a pair of strand directing pulleys each having a peripheral strand supporting rim cooperating with one of said apertures for changing the direction of the strand passing therethrough, each said pulley being mounted for rotation in a plane perpendicular to said mounting plate plane and adjustable supporting means mounting each of said pulleys on said base plate for independent arcuate adjustment thereof in a plane parallel to said mounting plane while maintaining the rim of said pulley tangent to the axis of its cooperating base plate aperture and the rims of both pulleys tangent to a plane parallel to said mounting plane each said supporting means including a link having a pulley rotatably mounted thereon, said link having a circular aperture, of the same diameter as its cooperating base plate aperture, in a link movement plane parallel to said mounting plane, the axis of said link aperture being generally perpendicular to said mounting plane and coaxial with its cooperating base plate aperture and link mounting means permanently rotatably mounting said link on said base plate for arcuate movement about the axis of its cooperating base plate aperture, said link mounting means comprising a permanently installed grommet member having a cylindrical central portion extending through said link aperture and its cooperating base plate aperture and outwardly flanged end portions, one of said end portions overlying said link and the other of said end portions overlying said base plate maintaining said link and cooperating base plate aperture coaxial and adjacent to one another for said arcuate adjustment thereof, each said link extending in a direction from its said aperture axis toward the side of said rudder post wheel to which its strand is connected said strands extending directly from said pulleys to opposite sides of said rudder post wheel without crossing one another, and extending directly from said pulleys to said opposite portions of said steering actuating means and crossing one another while remaining spaced from one another and locking means on said base plate and each said link for selectively securing each said link in arcuately adjusted position on said base plate, said locking means including a curved slot in said base plate of constant radius from a said aperture axis a fastener receiving opening in each said link spaced from its aperture axis and fastener means extending through each said slot and said opening for clamping each said link to said base plate.

* * * * *